United States Patent [19]

Hawk

[11] Patent Number: 4,782,759

[45] Date of Patent: Nov. 8, 1988

[54] DUAL SEALED COMPOSITE WAD STRUCTURE

[76] Inventor: Walter J. Hawk, P.O. Box 191, Jefferson City, Tenn. 37760

[21] Appl. No.: 68,990

[22] Filed: Jun. 30, 1987

[51] Int. Cl.[4] ..... F42B 7/08

[52] U.S. Cl. ..... 102/450; 102/532

[58] Field of Search ..... 102/448, 449, 450, 451, 102/453, 461, 532

[56] References Cited

U.S. PATENT DOCUMENTS

| | | |
|---|---|---|
| 3,285,174 | 11/1966 | Moehlman et al. . |
| 3,402,664 | 9/1968 | Cramer . |
| 3,516,360 | 6/1970 | Lathrope et al. . |
| 3,653,326 | 4/1972 | Hawsam et al. . |
| 3,727,557 | 4/1973 | Starcevich . |
| 4,164,903 | 8/1979 | Bouza . |
| 4,627,356 | 12/1986 | Buczkowski . |
| 4,676,170 | 6/1987 | Roster . |

*Primary Examiner*—Charles T. Jordan
*Assistant Examiner*—Richard Klein
*Attorney, Agent, or Firm*—Pitts and Brittian

[57] ABSTRACT

A dual sealed composite wad structure for use within a cartridge for a firearm. The wad structure comprises the following described integrally joined components: a shot column which has at least two separate, pliable petals; a shot column gas seal which forms the base of the shot column and fits against the interior surface of the cartridge to form a gas seal; a powder chamber gas seal; and a post section which has at least two pliable crimped post members attached between the shot column seal and the powder chamber gas seal. The powder chamber gas seal has an inverted cup-shaped lower surface providing an outer rim which fits loosely against the interior wall of the cartridge. The diameter of the powder chamber gas seal is smaller than the diameter of the shot column gas seal such that, upon ignition of the powder below the powder chamber gas seal, a limited amount of propulsive gas escapes into the post section. Under gas pressure, the rim of the shot column gas seal flares outwardly against the cartridge wall, thus preventing gas escape from the post section, and the rim of the powder chamber gas seal flares outwardly against the cartridge wall and confines the greater part of the propulsive force beneath the powder chamber gas seal. The dual seals of the current invention, in addition to the action of the crimped posts, thereby act to preclude shot deformation and reduce recoil without loss of shot velocity.

14 Claims, 1 Drawing Sheet

DUAL SEALED COMPOSITE WAD STRUCTURE

DESCRIPTION:

1. Technical Field

This invention relates generally to wad structures for firearm cartridges and specifically to composite wad structures designed to function as a powder chamber gas seal, a post section, and a shot column for insertion into a cylindrical cartridge.

2. Background Art

Various designs of composite wad structures exist. Typically they are molded of pliable, synthetic plastics such as polyethylene and have three general components: (1) a combined powder chamber and gas seal (hereinafter "powder chamber gas seal"); (2) a shot column; and (3) a post section. The individual component designs and shapes vary widely from brand to brand. This is particularly true of the shot column and post section. At the lower end of the composite wad structure is a powder chamber gas seal which is usually shaped like a hollow, inverted cup with a closed, flat upper side. The post section is situated atop and integrally joined to the flat upper side of the powder chamber gas seal. Typically, the post section is partially hollow and contains multiple crimped posts designed to fold upon powder ignition. At the upper end of the composite wad structure is a hollow, cylindrical shot column having a circular wall which in the prior art has been designed as a single, continuous structure or as a multi-part structure composed of separate, overlapping petals.

During the past two decades and earlier, inventors have concentrated efforts toward obtaining a composite wad structure which upon firing would project a distant, accurate, dense shot cloud. Improvements in shot column designs have partially obtained this objective. Shot column designs having multiple separate petals which fold back upon exiting the firearm barrel have aided the projection of the shot cloud undeflected by the weight or aerodynamics of the wad structure. However, intense compression resulting from rapidly expanding ignited gases continues to produce deformed, flattened shot which resists straight projection and thus travels in an angular or curved path. Prior invertors have uniformly addressed this problem by altering the design of the crimped posts or other post section subpart of the wad to produce a post section that is both sufficiently stiff to (1) transfer to the shot the acceleration force necessary to achieve the desired shot projection and sufficiently collapsible to (2) cushion the shot against deformation caused by the acceleration force. The resilient quality of the crimped posts was solely relied upon to cushion the shot against deformation caused by compression of the wad upon firing. U.S. Pat. Nos. 3,285,174; 3,402,664; 3,516,360; 3,653,326; 3,727,557; and 4,004,522 exemplify these inventions. These efforts have met with partial success. However, because pressure resulting from rapidly expanding ignited gases forming the force of acceleration is solely confined beneath the powder chamber gas seal, shot deformation continues to cause an undesirably loose shot cloud pattern and strong recoil persists.

Accordingly, it is an object of the present invention to provide a composite wad structure with dual gas seal devices designed to strengthen the cushioning effect of the post section by confining a limited amount of propulsive gas within that section in addition to that confined beneath the powder chamber gas seal.

Another object of the present invention is to provide a dual sealed composite wad structure with enhanced cushioning effect whereby shot deformation is reduced and a more accurate, dense shot cloud is produced.

A further object of the present invention is to provide a dual sealed composite wad structure with enhanced cushioning effect thereby reducing shot deformation and recoil.

An additional object of the present invention is to provide a dual sealed composite wad structure with superior gas seal devices and consequently reduce the amount of powder needed to provide the requisite projection velocity Another object of the present invention is to provide a format for a dual sealed composite wad structure which may be easily and inexpensively manufactured.

DISCLOSURE OF THE INVENTION

Other objects and advantages of the present invention will become more apparent upon reviewing the detailed description and associated drawings of various embodiments of the dual sealed composite wad structure.

The invention is a dual sealed composite wad structure for use within a cartridge which has the following integrally joined components: a shot column composed of at least two separate, pliable, outwardly flared petals; a shot column gas seal which closes the lower end of the shot column and fits against the cartridge interior; a partially-hollow post section having at least two crimped posts capable of bending and resuming their original shape; and an inverted cup-shaped powder chamber gas seal.

The diameter of the powder chamber gas seal is made slightly smaller than the diameter of the shot column gas seal. Due to this difference, a limited amount of propulsive gas created by ignition of the gun powder is initially permitted to escape into the post section. Further escape is prevented by the shot column gas seal. Upon accumulation of sufficient gas pressure, the rim of the powder chamber gas seal flares outwardly against the cartridge. Consequently, further gas escape from the powder chamber is prevented and the resulting propulsive force is transferred throughout the composite wad structure to the shot. The gas pressure within the post section and the resilient nature of the crimped posts prevent complete compression of the post section. Consequently, shot deformation is precluded.

Although initial acceleration of the composite wad is slowed by an increased gas expansion area, ultimate velocity remains unimpaired due to the superior dual gas seal portions of this invention. As a result, the marksman will benefit from both a more accurate, dense shot cloud and less recoil.

BEST MODE FOR CARRYING OUT THE INVENTION

Figure 1:
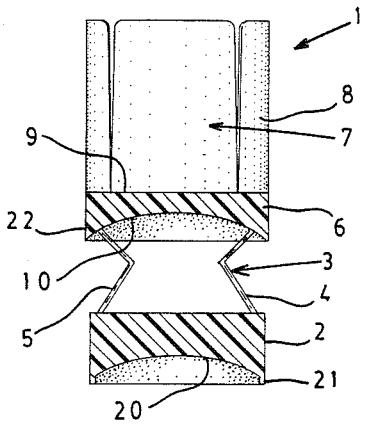
FIG. 1 illustrates a side view, partially in section, of one embodiment of the invention.
Figure 3:
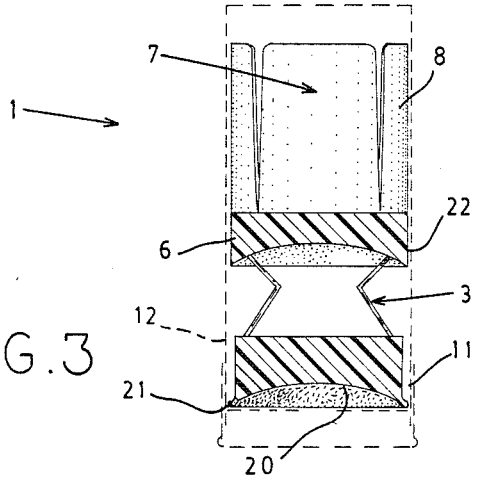
FIG. 3 illustrates a side view, partially in section, of the same embodiment of the invention as shown in FIG. 1 but as it is altered by propulsive gases which occur shortly after ignition of the gun powder.

Referring now to FIG. 1, there is shown generally at 1 the dual sealed composite wad structure of this invention as fitted within a cartridge 12 (See FIG. 3). The dual sealed composite wad structure consists of multiple, integrally joined components. A shot column 7, consists of at least two and preferably four pliable, separate, outwardly flaring petals, one of which is shown at 8. As shown in FIG. 1, when inserted into a cartridge, each petal substantially contacts another to form a substantially continuous shot column wall. Beneath the shot column is a shot column gas seal 6. The shot column gas seal has an upper side which may be planar as shown at 9 which forms the floor of the shot column and an inverted cup-shaped lower side 10 and an outer rim 22.

Within the post section, there are at least two crimped posts, such as the inwardly crimped posts, 4 and 5. The plastic, such as polyethylene, of which the crimped posts are manufactured gives the crimped posts a resilient quality such that when further bent the crimped posts tend to resume their original shape.

Integrally joined to the lower ends of the crimped posts is a powder chamber gas seal 2, having an inverted cup-shaped lower surface 20 and an outer rim 21. The diameter of the powder chamber gas seal is smaller than the diameter of the shot column gas seal. The ratio of the smaller diameter of the powder chamber gas seal to the larger diameter of the shot column gas seal is about 0.94 to 0.97. This size difference causes a gap 11 (See FIG. 3) between the powder chamber gas seal 2 and the interior of the cartridge 12. Upon ignition of the powder below the powder chamber gas seal a limited amount of propulsive gas escapes the powder chamber gas seal through the gap 11 and is trapped within the post section 3. Under gas pressure, the rim 22 of the shot column gas seal 6 flares outwardly against the interior of the cartridge wall, thus preventing gas escape from the post section. Under further gas pressure, the rim 21 of the powder chamber gas seal 2 flares outwardly against the cartridge wall and confines the greater part of the propulsive force beneath the powder chamber gas seal. Gas pressure trapped within the post section acts in conjunction with the resilient quality of the crimped posts to prevent complete compression of the post section. The crimped posts contract under pressure of propulsive gas, yet resume their original shape immediately thereafter. The dual seals of the current invention, in addition to the action of the crimped posts, thus act to preclude shot deformation and reduce recoil.

Figure 2:
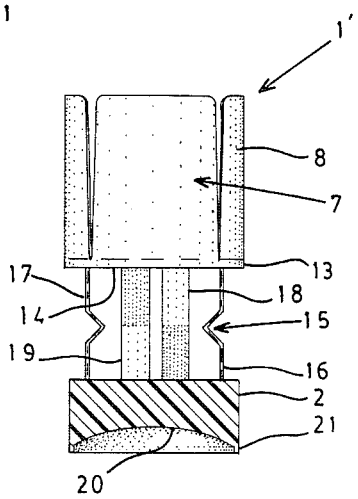
FIG. 2 illustrates a side view, partially in section, of another embodiment of the invention.

Referring now to FIG. 2, an alternative shot column gas seal design is shown at 13. The shot column gas seal is circular and, unlike the shot column gas seal shown in FIG. 1, has a planar lower side 14. In other respects, this shot column gas seal functions similarly to the one shown in FIG. 1. For example, the outer edge of the shot column gas seal fits firmly against the cartridge 12, and upon ignition of the gun powder and accumulation of gas pressure within the post section 15, the shot column gas seal does not permit gas to escape from the post section. An alternative post section design is shown generally at 15. This post section contains two pairs of crimped posts. The first pair of crimped posts, 16 and 17, are parallel, crimped preferably inwardly, and each is situated opposite the other along the outer edge of the post section. The second pair of crimped posts, 18 and 19 is situated between the other crimped posts and each post is crimped in opposing directions. Like the crimped posts shown in FIG. 1, these crimped posts have a resilient nature such that when additionally bent, they tend to resume their original shape when forces are released. This property, coupled with the entrapment of propulsive gases as described above in reference to FIG. 1, prevents complete compression of the post section upon firing. Consequently, the shot is cushioned and shot deformation precluded.

Referring now to FIG. 3, there is shown generally the same embodiment of the dual seal composite wad structure as shown in FIG. 1. However, FIG. 3 illustrates the flaring function of the dual gas seals, 6 and 2, when under pressure of propulsive gases. When under such pressure, the rim 22 of the larger shot column gas seal 6 closes against the interior of the cartridge and prevents gas escape beyond the post section. Under sufficient pressure the outer rim 21 of the powder chamber gas seal 2 also flares against the interior of the cartridge, thus confining most of the propulsive force beneath the powder chamber gas seal after an initial release into the post section.

Although there have been described particular embodiments of the present invention of a dual seal composite wad structure, it is not intended that such specific references be considered as limitations on the scope of this invention except insofar as set forth in the following claims and their equivalents.

I claim:

1. A dual sealed composite wad structure for use within a cartridge for a firearm which produces less shot deformation and provides a more accurate, dense shot cloud, such composite wad structures comprising:

a shot column member for receiving shot of said cartridge, said shot column member having a base for substantially conforming with an interior surface of said cartridge to form a gas seal therebetween, and at least two pliable petal-shaped elements extending from said base, said petal-shaped elements configured whereby edges thereof closely approach to form a substantially continuous shot column wall when within said cartridge but substantially diverge when exterior said cartridge;

a post section having at least two pliable post members each having a first end integrally joined to said base of said shot column, and a further end, said post members each being provided with a crimped portion intermediate said first and further ends whereby said post members bend upon application of compression force to opposite ends and resume initial configuration upon removal of said compressive force; and a powder chamber gas seal member, said powder chamber gas seal member provided with an upper surface integrally joined to said further ends of said post members, and an inverted cup-shaped lower surface defining an outer rim, said outer rim of said powder chamber gas seal having a diameter about 0.94 to about 0.97 times a diameter of said base of said shot column member, said powder chamber gas seal defining a peripheral cylindrical surface to be proximate to but spaced from said inner surface of said cartridge when within said cartridge to define a gap between said peripheral and said inner surface, said gap providing initial partial escape of gases from below said powder chamber gas seal into said post section.

2. The composite wad structure of claim 1 wherein said shot column member is provided with four equal petal-shaped elements, each of said petal elements configured whereby edges thereof closely approach to form a substantially continuous shot column wall for holding said shot.

3. The composite wad structure of claim 1 wherein said post section comprises two symmetrically positioned post members, each of said post members having a pair of leg members oriented angularly toward an axis of said composite wad structure and joined at an apex whereby said post members are crimped in a direction toward said axis.

4. The composite wad structure of claim 1 wherein said outer rim of said powder chamber gas seal is sufficiently pliable whereby said rim expands to contact said inner surface of said cartridge upon ignition of powder within said cartridge producing gas pressure against said cup-shaped lower surface of said powder chamber gas seal following said partial release of said gas pressure through said gap into said post section.

5. The composite wad structure of claim 3 wherein said base of said shot column member is provided with an inverted cup-shaped surface directed toward said post section with said first ends of said post elements integrally joined to said inverted cup-shaped surface, said inverted cup-shaped surface of said shot column member terminating in a pliable peripheral rim whereby gas pressure against said inverted cup-shaped surface forces said rim into close engagement with said inner surface of said cartridge to prevent gas escape from said post section into said shot column member.

6. The composite wad structure of claim 1 wherein said post section comprises four pliable post members each having first and further ends, said post members each being crimped at a location between said first and further ends whereby said post elements bend upon application of compressive force on said further ends and resume initial orientation upon removal of said compressive force.

7. The composite wad structure of claim 6 wherein said four post elements comprise a first pair of symmetrically disposed post elements and a second pair of symmetrically disposed post elements, each of said post elements of said first pair being crimped in opposed directions and each of said post elements of said second pair being crimped in opposed directions, said crimp directions of said second pair of post elements oriented at substantially right angles to crimp directions of said first pair of post elements.

8. The composite wad structure of claim 7, wherein said first pair of post elements are symmetrically disposed a greater distance from an axis of said wad structure than said second pair of post elements.

9. The composite wad structure of claim 8 wherein each of said post elements of said first pair are crimped in a direction away from said inner surface of said cartridge, and each of said post elements of said second pair are crimped in a direction toward said inner surface of said cartridge.

10. A dual sealed composite wad structure for use within a cartridge for a firearm which produces less shot deformation and provides a more accurate, dense shot cloud, such composite wad structure comprising:

a shot column member for receiving shot of said cartridge, said shot column member having a base with a peripheral surface of a selected diameter for substantially conforming with an interior surface of said cartridge to form a gas seal therebetween, and four pliable petal-shaped elements extending from said base, said petal-shaped elements configured whereby edges thereof closely approach to form a substantially continuous shot column wall when within said cartridge but substantially diverge when exterior said cartridge;

a post section having at least two pliable post members each having a first end integrally joined to said base of said shot column, and a further end, said post members each being provided with a crimped portion intermediate said first and further ends whereby said post members bend upon application of compression force to opposite ends and resume initial configuration upon removal of said compressive force; and a powder chamber gas seal member, said powder chamber gas seal member provided with an upper surface integrally joined to said further ends of said post members, and an inverted cup-shaped lower surface defining an outer rim, said powder chamber gas seal defining a peripheral cylindrical surface of a selected diameter proximate to but spaced from said inner surface of said cartridge when within said cartridge to define a gap between said periphery and said inner surface, said selected diameter of said peripheral surface of said gas seal member being about 0.94 to about 0.97 times said selected diameter of said peripheral surface of said shot column base.

11. The composite wad structure of claim 10 wherein said post section comprises two symmetrically positioned post members, each of said post members having a pair of leg members oriented angularly toward an axis of said composite wad structure and joined at an apex whereby said post members are crimped in a direction toward said axis.

12. The composite wad structure of claim 10 wherein said post section comprises a first pair of symmetrically disposed post elements and a second pair of symmetrically disposed post elements, each of said post elements of said first pair being crimped in opposed directions and each of said post elements of said second pair being crimped in opposed directions, said crimp directions of said second pair of post elements oriented at substantially right angles to crimp directions of said first pair of post elements.

13. The composite wad structure of claim 12 wherein said first pair of post elements are symmetrically disposed a greater distance from an axis of said wad structure than said second pair of post elements.

14. A dual sealed composite wad structure for use within a cartridge for a firearm which produces less shot deformation and provides a more accurate, dense shot cloud, such composite wad structure comprising:

a shot column member for receiving shot of said cartridge, said shot column member having an inverted cup-shaped base defining a pliable outer rim for substantially conforming to an interior surface of said cartridge to form a gas seal therebetween, said shot column member having four pliable petal-shaped elements extending from said base, said petal-shaped elements configured whereby edges thereof closely approach to form a substantially continuous shot column wall when within said cartridge but substantially diverge when exterior said cartridge;

a post section having at least two symmetrically positioned pliable post members each having a first end integrally joined to said base of said shot column, and a further end, said post members each being provided with a crimped portion intermediate said first and further ends whereby said post members bend upon application of compressive force against said further ends and resume initial configuration upon removal of said compressive force; and a powder chamber gas seal member, said powder chamber gas seal member provided with an upper surface integrally joined to said further ends of said post members, and a cup-shaped lower surface defining an outer rim, said powder chamber gas seal defining a peripheral cylindrical surface to be proximate but spaced from said inner surface of said cartridge when within said cartridge to define a gap between said periphery and said inner surface, said peripheral cylindrical surface of said powder chamber gas seal having a diameter of about 0.94 to about 0.97 times a diameter of said base of said shot column member, and wherein said outer rim of said powder chamber gas seal is sufficiently pliable whereby said outer rim expands to contact said inner surface of said cartridge upon ignition of powder within said cartridge after an initial release of gas pressure into said post section through said gap.

* * * * *